US009775390B2

(12) United States Patent
Sheedy

(10) Patent No.: US 9,775,390 B2
(45) Date of Patent: Oct. 3, 2017

(54) ABSORBENT WRISTBAND APPARATUS

(71) Applicant: WashBands, LLC, Novato, CA (US)

(72) Inventor: Megan Sheedy, Novato, CA (US)

(73) Assignee: WashBands, LLC, Pacifica, CA (US)

( * ) Notice: Subject to any disclaimer, the term of this patent is extended or adjusted under 35 U.S.C. 154(b) by 159 days.

(21) Appl. No.: 14/879,352

(22) Filed: Oct. 9, 2015

(65) Prior Publication Data

US 2016/0100639 A1 Apr. 14, 2016

Related U.S. Application Data

(60) Provisional application No. 62/063,503, filed on Oct. 14, 2014.

(51) Int. Cl.
*A41D 19/00* (2006.01)
*A41D 20/00* (2006.01)

(52) U.S. Cl.
CPC ..... *A41D 20/00* (2013.01); *A41D 19/0031* (2013.01); *A41D 19/0034* (2013.01); *A41D 19/0037* (2013.01); *A41D 19/0041* (2013.01); *A41D 19/0048* (2013.01); *A41D 19/0093* (2013.01)

(58) Field of Classification Search
CPC ..... A41D 19/0034; A41D 19/0037; A41D 19/0041; A41D 19/0093; A41D 20/00; A41D 20/005
See application file for complete search history.

(56) References Cited

U.S. PATENT DOCUMENTS 2,316,033 A * 4/1943 Walsh ..... A41D 19/0034 2/162
2,643,389 A 6/1953 Theodor
2,710,409 A * 6/1955 Burandt ..... A41D 19/0034 2/160
2,754,532 A * 7/1956 Kanehl ..... A41B 15/00 15/209.1
4,047,400 A 9/1977 Thorneburg
D255,509 S * 6/1980 Nathan ..... D3/226
4,351,067 A * 9/1982 Bartels ..... A41D 19/0034 2/160
4,843,653 A * 7/1989 Coble ..... A41D 20/00 2/162
4,899,749 A * 2/1990 Laroco ..... A61F 7/08 383/901

(Continued)

*Primary Examiner* — Khaled Annis
(74) *Attorney, Agent, or Firm* — PatentFile, LLC; Bradley C. Fach; Steven R. Kick

(57) ABSTRACT

An absorbent wristband apparatus is provided. In some embodiments, the apparatus may comprise a body with a first end and a second end. The body may be formed into a hollow cylindrical shape with a first opening at the first end and a second opening at the second end. A cavity may be disposed in the body and may be continuous between the opening at the first end and the opening at the second end. A first elastic element may be coupled at a first end of the body and a second elastic element may be coupled at a second end of the body. The apparatus may also comprise one or more fasteners such as a loop fastener and/or a button fastener which may preferably be coupled to the body proximate to an elastic element and/or proximate to an end.

13 Claims, 6 Drawing Sheets

(56) References Cited

U.S. PATENT DOCUMENTS 4,944,042 A * 7/1990 DeWan ..... A41D 15/04 190/1
4,970,631 A * 11/1990 Marshall ..... A41D 20/00 362/105
5,139,187 A * 8/1992 Fowler ..... A41D 13/081 2/162
5,187,813 A 2/1993 Klein
5,331,686 A * 7/1994 Marshall ..... A41D 20/005 2/171.8
5,448,458 A * 9/1995 Smyly, Jr. ..... F21L 4/00 362/103
5,797,142 A * 8/1998 Debronsky, Jr. ..... A45F 5/02 15/208
6,108,855 A * 8/2000 DeLeon ..... A01K 97/00 15/208
6,286,152 B1 * 9/2001 Mooneyhan ..... A41F 9/025 2/237
6,405,381 B1 6/2002 Bowman
6,708,733 B2 3/2004 Iizuka
6,786,666 B1 * 9/2004 Floyd-Williams ..... A45D 34/04 15/222
9,271,531 B2 * 3/2016 Rothschild ..... A41D 20/00
2005/0193465 A1 * 9/2005 Salvitti ..... A63B 71/14 2/161.5
2006/0248624 A1 * 11/2006 Pieczynski ..... A41D 13/081 2/16
2007/0095871 A1 * 5/2007 Chen ..... A45F 5/00 224/219
2012/0061430 A1 * 3/2012 Hall ..... A44C 5/00 224/164
2013/0014309 A1 1/2013 Jewell
2013/0047319 A1 * 2/2013 Canale ..... A41D 27/10 2/243.1
2016/0235137 A1 * 8/2016 Infante ..... A41D 19/0034
2017/0113429 A1 * 4/2017 Pols ..... A44B 17/0041

* cited by examiner

ABSORBENT WRISTBAND APPARATUS

CROSS REFERENCE TO RELATED APPLICATIONS

This application claims priority to and the benefit of the filing date of U.S. Provisional Application No. 62/063,503, filed on Oct. 14, 2014, entitled "ABSORBENT WRISTBAND APPARATUS", which is hereby incorporated by reference in its entirety.

FIELD OF THE INVENTION

This patent specification relates to protective absorbent articles. More specifically, this patent specification relates to hygiene apparatuses that that enable a user to wash areas on a user while protecting other areas of the user from moisture.

BACKGROUND

In the course of maintaining good hygiene, an individual is required to wash their face to remove dirt, oil, and makeup. When performed over a sink or wash basin, an individual may splash or otherwise rinse water over their face by using their hands. Since the face is positioned above the sink or wash basin and over the hands and arms, some water invariably runs down the individual's arms and onto areas such as the counter, the individual's clothes, and the floor. In addition to wet clothes being an annoyance, water that is spilled onto counters and floors may become a safety issue leading to slips and falls. Similarly, washing any object that is above an individual's elbows will also result in some water running down the individual's arms and onto areas around the individual.

Some attempts have been made at preventing water from running down an individual's arms and onto areas around the individual when they are washing an object that is above the individual's elbows. For example, absorbent bands that cover approximately a one to two inch wide portion of an individual's wrist or arm attempt to absorb water that may run down the individual's arm. However, these bands typically are of such a size that they are unable to protect a majority of the individual's arm from running or splashed water. In fact, after a typical washing, these bands become thoroughly soaked with water and often do not have any dry surface areas remaining.

Other attempts at preventing water from running down an individual's arms have included absorbent bands that cover approximately a three to ten inch wide portion of an individual's wrist or arm attempt to absorb water that may run down the individual's arm. While these bands may have portions with dry surface areas remaining after a typical washing, they must be placed on a flat surface or on a specialty rack in order to dry. By requiring a flat surface or a specialty rack in order to dry, these bands may not be dry in time for the next washing, or they are limited in where they can be placed for drying.

Therefore, a need exists for novel absorbent apparatuses that are able to prevent water from running down an individual's arms and onto areas around the individual when they are washing an object that is above the individual's elbows. There also exists a need for novel absorbent apparatuses that are able to protect a majority of the individual's arm from running or splashed water. There is a further need for novel absorbent apparatuses that do not become thoroughly soaked with water and often do not have any dry surface areas remaining after a washing. Finally, there exists a need for novel absorbent apparatuses that do not require a flat surface or a specialty rack in order to dry, and are therefore limited in where they can be placed for drying.

BRIEF SUMMARY OF THE INVENTION

An absorbent wristband apparatus is provided. In some embodiments, the apparatus may comprise a body with a first end and a second end. The body may be formed into a hollow cylindrical shape with a first opening at the first end and a second opening at the second end. A cavity may be disposed in the body and may be continuous between the opening at the first end and the opening at the second end. A first elastic element may be coupled at a first end of the body and a second elastic element may be coupled at a second end of the body. The apparatus may also comprise one or more fasteners such as a loop fastener and/or a button fastener which may preferably be coupled to the body proximate to an elastic element and/or proximate to an end.

In further embodiments, the apparatus may comprise a female absorbent wristband apparatus, which may include a body with a first end and a second end. The body may be formed into a hollow cylindrical shape with a first opening at the first end and a second opening at the second end. A cavity may be disposed in the body which may be continuous between the opening at the first end and the second opening at the second end. A first elastic element may be coupled at the first end of the body and a second elastic element may be coupled at the second end of the body. A fastener may also be coupled to the body. The apparatus may also comprise a male absorbent wristband apparatus, which may include a body with a first end and a second end. The body may be formed into a hollow cylindrical shape with a first opening at the first end and a second opening at the second end. A cavity may be disposed in the body which may be continuous between the opening at the first end and the second opening at the second end. A first elastic element may be coupled at the first end of the body and a second elastic element may be coupled at the second end of the body. A fastener may also be coupled to the body and the fastener of the female absorbent wristband apparatus may be configured to be removably coupled to the fastener of the male absorbent wristband apparatus.

BRIEF DESCRIPTION OF THE DRAWINGS

Some embodiments of the present invention are illustrated as an example and are not limited by the figures of the accompanying drawings, in which like references may indicate similar elements and in which:

FIG. 1A depicts a perspective view of an example of a female absorbent wristband apparatus while

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New absorbent apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1A:
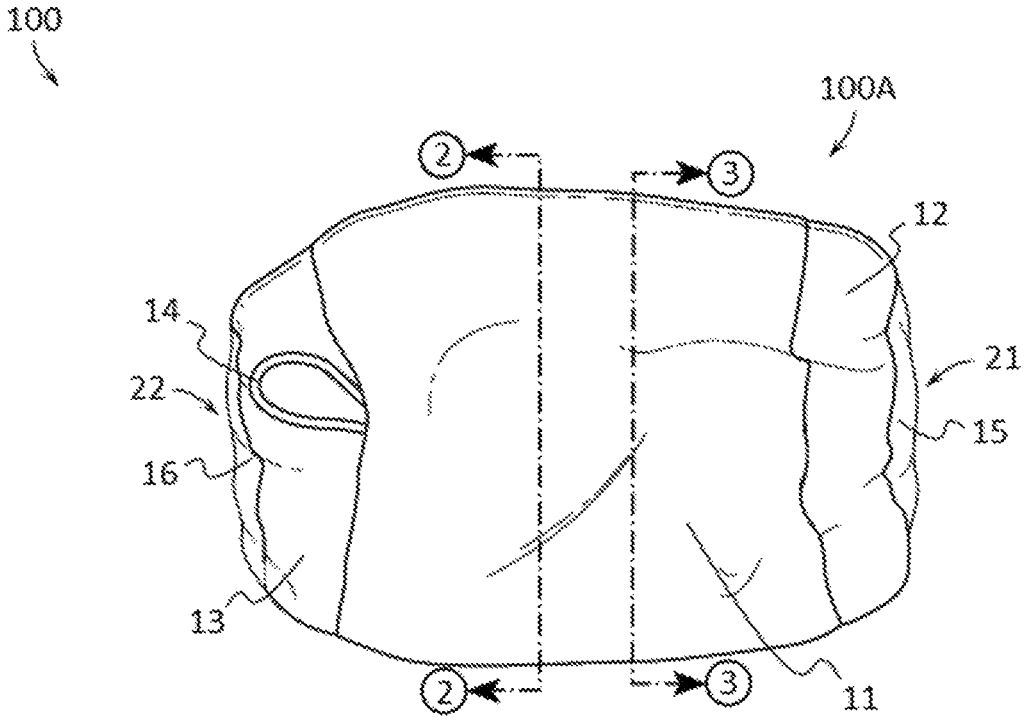
Figure 1B:
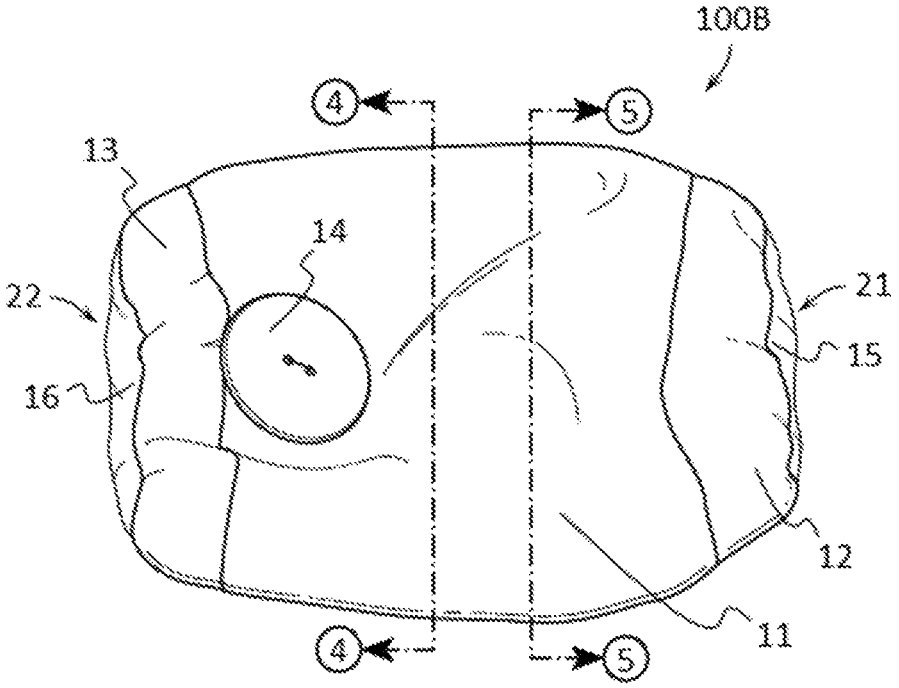
FIG. 1B depicts a perspective view of an example of a male absorbent wristband apparatus according to various embodiments described herein.

The present invention will now be described by example and through referencing the appended figures representing preferred and alternative embodiments. FIG. 1 illustrates an example of an absorbent wristband apparatus ("the apparatus") 100 according to various embodiments. In this example, the apparatus 100 comprises a female absorbent wristband apparatus ("the female apparatus") 100A and a male absorbent wristband apparatus ("the male apparatus") 100B. In other embodiments, an absorbent wristband apparatus 100 may comprise a female apparatus 100A or a male apparatus 100B. In further embodiments, an absorbent wristband apparatus 100 may comprise one or more female apparatuses 100A and/or one or more male apparatuses 100B.

In some embodiments, the apparatus 100 may comprise a body 11 which may be made from an absorbent material 31 and the body 11 may be formed into a hollow cylindrical shape. The body 11 may be made from an absorbent material 31 with a first end 21 and a second end 22. The body 11 may be formed into a hollow cylindrical shape with a first opening 15 at the first end 21 and a second opening 16 at the second end 22. A cavity 17 may be disposed in the body 11 and may be continuous between the opening 15 at the first end 21 and the opening 16 at the second end 22. A first elastic element 12 may be coupled at a first end 21 of the body 11 and a second elastic element 13 may be coupled at a second end 22 of the body 11. The apparatus 100 may also comprise one or more fasteners 14 such as a loop fastener 14A and/or a button fastener 14B which may preferably be coupled to the body 11 proximate to an elastic element 12, 13, and/or proximate to an end 21, 22.

Figure 2:
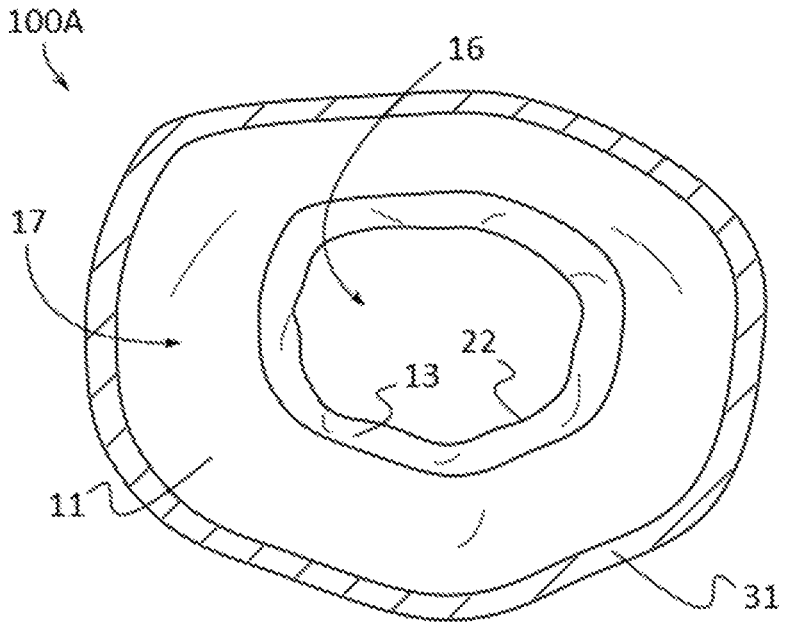
FIG. 2 illustrates a sectional, through line 2-2 shown in FIG. 1, elevation view of an example of a female absorbent wristband apparatus according to various embodiments described herein.
Figure 3:
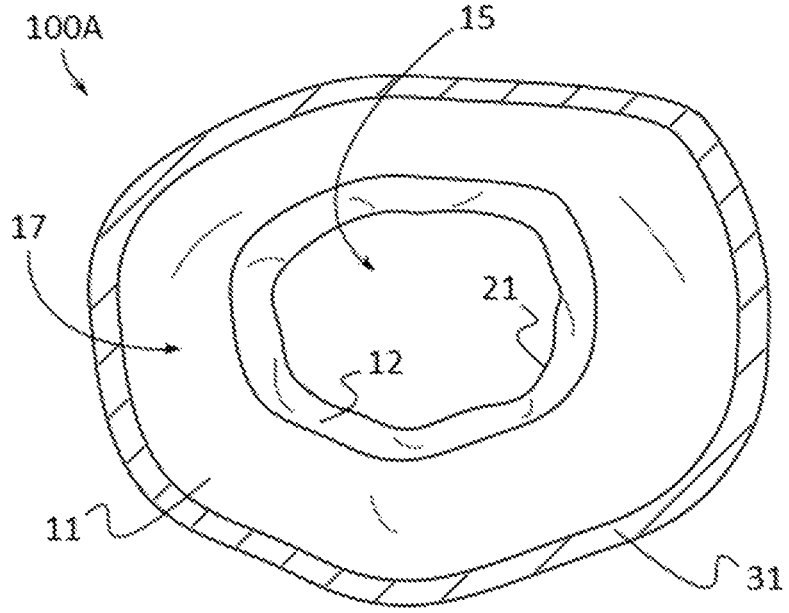
FIG. 3 shows a sectional, through line 3-3 shown in FIG. 1, elevation view of an example of a female absorbent wristband apparatus according to various embodiments described herein.
Figure 4:
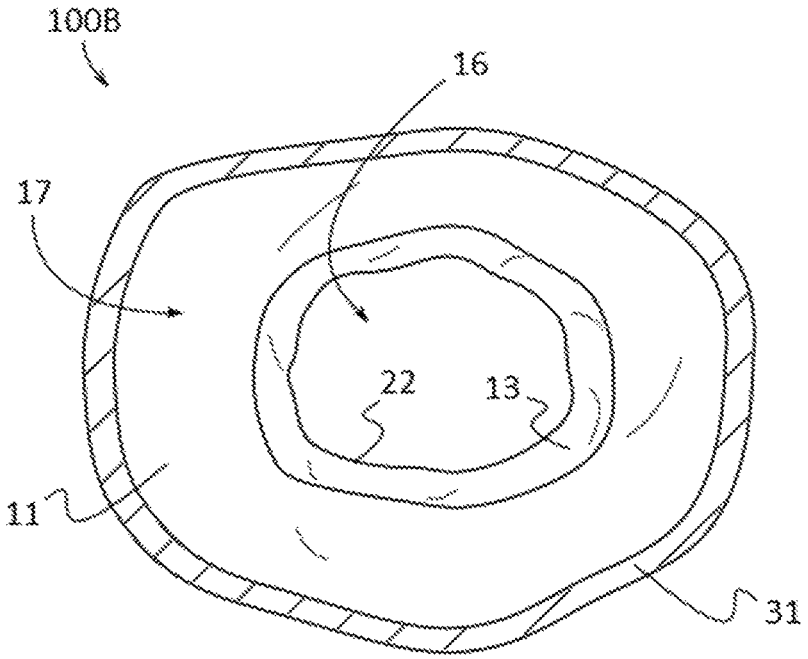
FIG. 4 depicts a sectional, through line 4-4 shown in FIG. 1, elevation view of an example of a male absorbent wristband apparatus according to various embodiments described herein.
Figure 5:
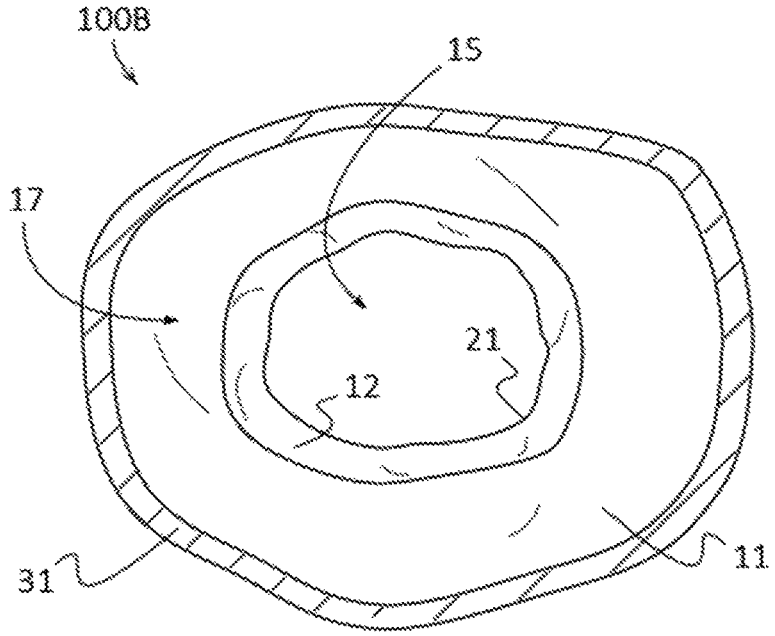
FIG. 5 illustrates a sectional, through line 5-5 shown in FIG. 1, elevation view of an example of a male absorbent wristband apparatus according to various embodiments described herein.

In further embodiments, the apparatus 100 may comprise a female absorbent wristband apparatus 100A, which may include a body 11 made from an absorbent material 31 (FIGS. 2 and 3) with a first end 21 and a second end 22. The body 11 may be formed into a hollow cylindrical shape with a first opening 15 at the first end 21 and a second opening 16 at the second end 22. A cavity 17 may be disposed in the body 11 which may be continuous between the opening 15 at the first end 21 and the second opening 16 at the second end 22. A first elastic element 12 may be coupled at the first end 21 of the body 11 and a second elastic element 13 may be coupled at the second end 22 of the body 11. A fastener 14 may also be coupled to the body 11. The apparatus 100 may also comprise a male absorbent wristband apparatus 100B, which may include a body 11 made from an absorbent material 31 (FIGS. 4 and 5) with a first end 21 and a second end 22. The body 11 may be formed into a hollow cylindrical shape with a first opening 15 at the first end 21 and a second opening 16 at the second end 22. A cavity 17 may be disposed in the body 11 which may be continuous between the opening 15 at the first end 21 and the second opening 16 at the second end 22. A first elastic element 12 may be coupled at the first end 21 of the body 11 and a second elastic element 13 may be coupled at the second end 22 of the body 11. A fastener 14 may also be coupled to the body 11 and the fastener 14 of the female absorbent wristband apparatus 100A may be configured to be removably coupled to the fastener 14 of the male absorbent wristband apparatus 100B.

Figure 8:
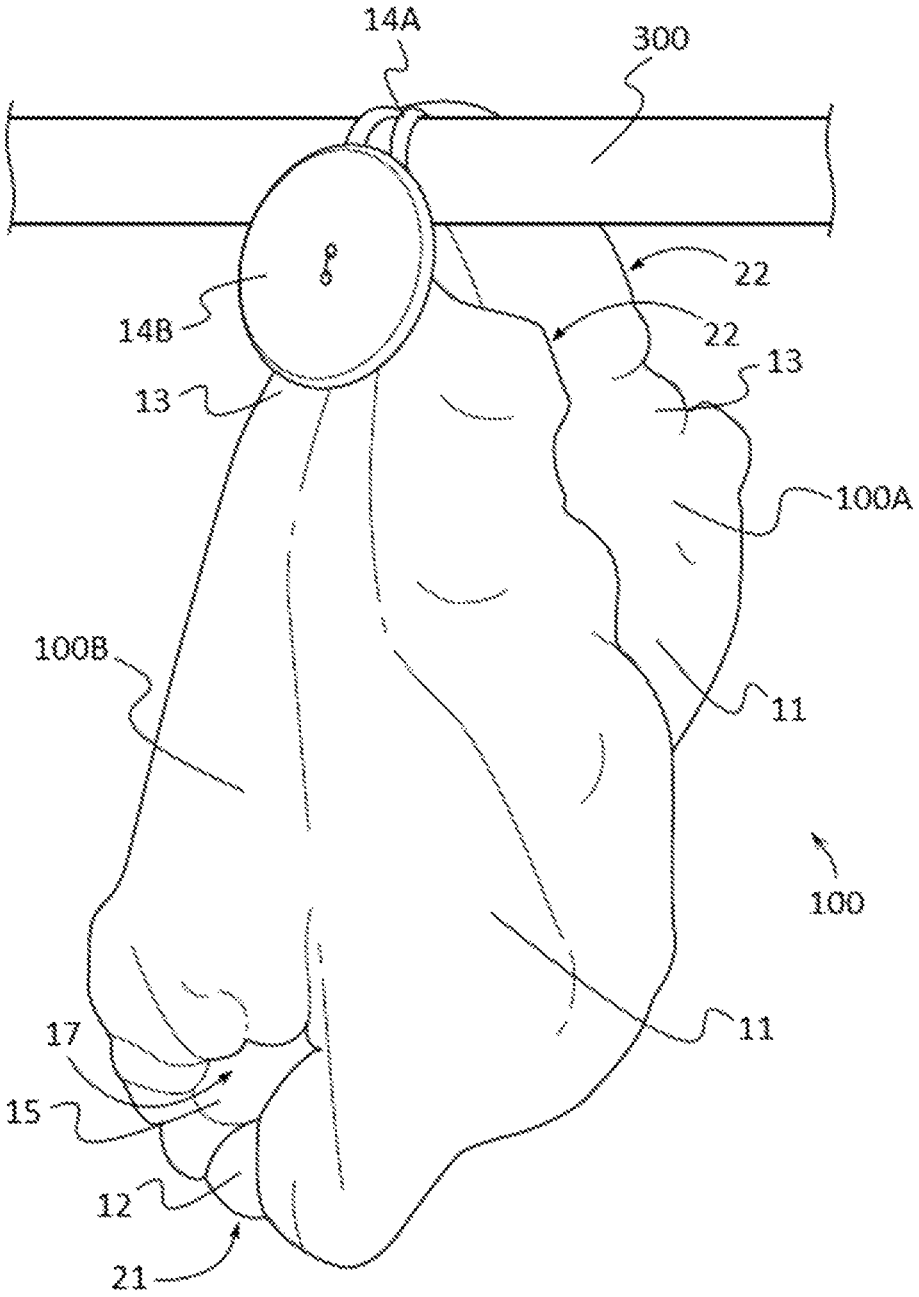
FIG. 8 illustrates a perspective view of an example of an absorbent wristband apparatus comprising a female absorbent wristband apparatus and a male absorbent wristband apparatus secured over or to an object according to various embodiments described herein.

An apparatus 100 comprising a female apparatus 100A and a male apparatus 100B may be temporarily secured over or to a structure 300 (FIG. 8) such as a bar or rod and to each other by positioning a loop fastener 14A and a button fastener 14B around or over the structure 300 and removably coupling the fasteners 14 of the apparatuses 100A, 100B, together as shown in FIG. 8. The female apparatus 100A and male apparatus 100B may then be draped over opposite sides of the structure 300 allowing the female apparatus 100A and male apparatus 100B to be removably coupled to each other and to be temporarily secured to the structure 300.

Referring to FIGS. 1-3, 7, 8, in some embodiments, a female apparatus 100A may comprise a body 11 which may be made from an absorbent material 31 and the body 11 may be formed into a hollow cylindrical shape. In further embodiments, a female apparatus 100A may comprise a body 11 which may be made from an absorbent material 31 with a first end 21 and a second end 22. The body 11 may be formed into a hollow cylindrical shape with a first opening 15 at the first end 21 and a second opening 16 at the second end 22. A cavity 17 may be disposed in the body 11 and may be continuous between the opening 15 at the first end 21 and the opening 16 at the second end 22. A first elastic element 12 may be coupled at a first end 21 of the body 11 and a second elastic element 13 may be coupled at a second end 22 of the body 11. The female apparatus 100A may also comprise one or more fasteners 14 such as a loop fastener 14A which may preferably be coupled to the body 11 and/or to an elastic element 12.

In some embodiments, a body 11 of a female apparatus 100A may be configured to cover portions of a user's hand 201 (FIG. 6) or arm 204 (FIGS. 6 and 7), such as between 10 to 50 percent, and preferably most of a user's hand 201 or arm 204 such as between 51 to 100 percent. Portions of a user's hand 201 or arm 204 may be received in the cavity 17 thereby allowing the body 11 of a female apparatus 100A to cover between 10 to 100 percent of a user's hand 201 or arm 204. In further embodiments, the cavity 17 may permit approximately 20 percent to 100 percent of the hand 201 of a user to be received within the cavity 17 as shown in FIG. 7.

In some embodiments, portions of a user's hand 201 (FIG. 6) and/or arm 204 (FIGS. 6 and 7) may be received in the cavity 17 of the female apparatus 100A by first inserting the hand 201 through an opening 15, 16, of the body 11. By continuing the insertion, the body 11 may be positioned on the arm 204 to cover desired portions of a user's hand 201 and/or arm 204. In further embodiments, the size of the first opening 15 at the first end 21 may be governed by the first elastic element 12 coupled at the first end 21. Likewise, the size of the second opening 16 at the second end 22 may be governed by the second elastic element 13 coupled at the second end 22. The elastic elements 12, 13, of the female apparatus 100A may be made or comprise an elastic or resilient material which may stretch to increase the size of the openings 15, 16, and also contract to decrease size of the openings 15, 16, thereby allowing the elastic elements 12, 13, to govern the size of their respective opening 15, 16.

Referring now to FIGS. 1, 4-6, 8, in some embodiments, a male apparatus 100B may comprise a body 11 which may be made from an absorbent material 31 and the body 11 may be formed into a hollow cylindrical shape. In further embodiments, a male apparatus 100B may comprise a body 11 which may be made from an absorbent material 31 with a first end 21 and a second end 22. The body 11 may be formed into a hollow cylindrical shape with a first opening 15 at the first end 21 and a second opening 16 at the second end 22. A cavity 17 may be disposed in the body 11 and may be continuous between the opening 15 at the first end 21 and the opening 16 at the second end 22. A first elastic element 12 may be coupled at a first end 21 of the body 11 and a second elastic element 13 may be coupled at a second end 22 of the body 11. The male apparatus 100B may also comprise one or more fasteners 14 such as a button fastener 14B which may preferably be coupled to the body 11 and/or to an elastic element 12.

In some embodiments, a body 11 of a male apparatus 100B may be configured to cover portions of a user's hand 201 (FIG. 6) or arm 204 (FIGS. 6 and 7), such as between 10 to 50 percent, and preferably most of a user's hand 201 or arm 204 such as between 51 to 100 percent. Portions of a user's hand 201 or arm 204 may be received in the cavity 17 thereby allowing the body 11 of a male apparatus 100B to cover between 10 to 100 percent of a user's hand 201 or arm 204. In further embodiments, the cavity 17 may permit approximately 20 percent to 100 percent of the hand 201 of a user to be received within the cavity 17 as shown in FIG. 7.

In some embodiments, portions of a user's hand 201 (FIG. 6) and/or arm 204 (FIGS. 6 and 7) may be received in the cavity 17 of the male apparatus 100B by first inserting the hand 201 through an opening 15, 16, of the body 11. By continuing the insertion, the body 11 may be positioned on the arm 204 to cover desired portions of a user's hand 201 and/or arm 204. In further embodiments, the size of the first opening 15 at the first end 21 may be governed by the first elastic element 12 coupled at the first end 21. Likewise, the size of the second opening 16 at the second end 22 may be governed by the second elastic element 13 coupled at the second end 22. The elastic elements 12, 13, of the male apparatus 100B may be made or comprise an elastic or resilient material which may stretch to increase the size of the openings 15, 16, and also contract to decrease size of the openings 15, 16, thereby allowing the elastic elements 12, 13, to govern the size of their respective opening 15, 16.

In preferred embodiments, a body 11 may comprise a layer of absorbent material 31 with an elastic element 12 coupled to a first end 21 and an elastic element 13 coupled to a second end 22 of the generally cylindrically shaped body 11. In preferred embodiments, a first end 21 may comprise a triple layer or three layers of an absorbent material 31 surrounding an elastic element 12, and a second end 22 may comprise a double layer or two layers of an absorbent material 31 surrounding an elastic element 13. In other embodiments, a first end 21 and/or a second end 22 may comprise one, two, three, four, five, six, or more layers of absorbent material 31 surrounding an elastic element 12, 13. In further embodiments, a first end 21 and/or a second end 22 may comprise an elastic element 12, 13 that may be preferably absorbent in nature such as Lycra® or elastane that may be coupled to the body 11.

In preferred embodiments, the body 11 of a female apparatus 100A and the body of a male apparatus 100B may be made from a soft fabric absorbent material 31 such as terry cloth. In other embodiments, a body 11 may comprise absorbent materials 31 including synthetic fabrics such as polyester, polyamides, acrylic, nylon, rayon, acetate, spandex, lastex, and natural fabrics such as coir, cotton, terry cloth, hemp, jute, linen, ramie, wool, silk, or any other suitable flexible natural or synthetic material including combinations of materials.

In preferred embodiments, an elastic element 12, 13, of a female apparatus 100A and an elastic element 12, 13, of a male apparatus 100B may be made of a braided elastic material, a woven elastic material, or a knitted elastic material. In other embodiments, an elastic element 12 may comprise elastic materials including braided elastic fabric materials, woven elastic fabric materials, knitted elastic fabric materials, neoprene, spandex, elastane, cotton swimwear elastic, roll elastic, non-roll elastic, rubber, silicone, elastic plastics, elastic silicone, elastic rubbers, silicone rubbers, or any other suitable elastic, elastomer, or other resilient material.

In further preferred embodiments, an elastic element 12, 13, may comprise an elastic, elastomer, or other resilient material that may be wrapped in the same absorbent material as used to form a body 11 and then sealed or coupled with stitching to maintain the elastic, elastomer, or other resilient material within the absorbent material. A fastener 14, such as a loop fastener 14A, button fastener 14B, or any other type of fastener may be coupled by being sewn to the body 11 such as to an elastic element 12, 13, of a female apparatus 100A and/or a male apparatus 100B with a flexible coupling such as stitching.

In some embodiments, an apparatus 100 (FIGS. 1 and 4) may comprise a fastener 14 such as a loop fastener 14A coupled to the body 11 proximate to the second end 22 of a female apparatus 100A and a fastener 14 such as a button fastener 14B coupled to the body 11 proximate to the second end 22 of a male apparatus 100B. In other embodiments, an apparatus 100 may comprise a fastener 14 such as a loop fastener 14A coupled proximate to the first end 21 of a female apparatus 100A and a fastener 14 such as a button fastener 14B coupled proximate to the first end 21 of a male apparatus 100B. In further embodiments, a female apparatus 100A may comprise a fastener 14 such as a loop fastener 14A positioned on one end 21, 22, and a fastener 14 such as a button fastener 14B positioned on the other end 21, 22, of a female apparatus 100A. In further embodiments, a male apparatus 100B may comprise a fastener 14 such as a loop fastener 14A positioned on one end 21, 22, and a fastener 14 such as a button fastener 14B positioned on the other end 21, 22, of a male apparatus 100B.

In even further embodiments, a female apparatus 100A may comprise a fastener 14, such as a loop fastener 14A, positioned on one end 21, 22, and a fastener 14, such as a button fastener 14B, positioned on the same end 21, 22, of a female apparatus 100A. In further embodiments, a male apparatus 100B may comprise a fastener 14, such as a loop fastener 14A, positioned on one end 21, 22, and a fastener 14, such as a button fastener 14B, positioned on the same end 21, 22, of a male apparatus 100B. In still further embodiments, a female apparatus 100A may comprise a fastener 14, such as a loop fastener 14A, positioned anywhere on the body 11 or on an elastic element 12 of a female apparatus 100A, while a male apparatus 100B may comprise a fastener 14, such as a button fastener 14B, positioned anywhere on the body 11 or on an elastic element 12 so that by optionally bending or folding one or both bodies 11 of the female apparatus 100A and/or the male apparatus 100B, two fasteners 14 may be brought and removably coupled together.

A loop fastener 14A may comprise a loop of string, cord, fabric, yarn, or the like which may be configured to receive and secure a button fastener 14B. A button fastener 14B may comprise a round button, an elongated button, or any other style or shape of button. A loop fastener 14A may be removably coupled to a button fastener 14B by inserting the button fastener 14B within the loop of a loop fastener 14A. In preferred embodiments, a female apparatus 100A and/or a male apparatus 100B may comprise one or more fasteners 14 such as a button fastener 14B, a loop fastener 14A, or any other type of fastener. In alternative embodiments, a female apparatus 100A and/or a male apparatus 100B may comprise one or more other types of fasteners such as magnetic type fasteners, Velcro® type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the function of securing a female apparatus 100A and/or a male apparatus 100B to an object.

Figure 6:
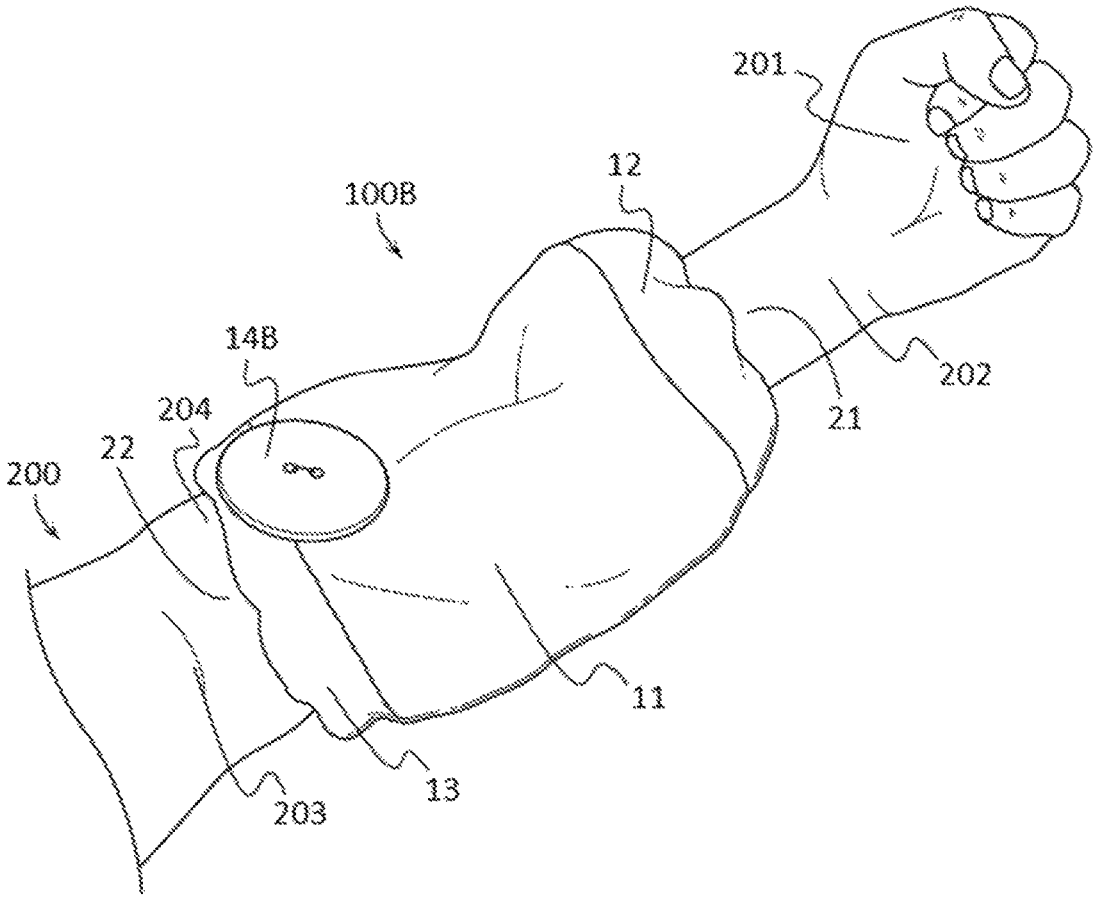
FIG. 6 shows a perspective view of an example of a male absorbent wristband apparatus worn on the arm of a user according to various embodiments described herein.
Figure 7:
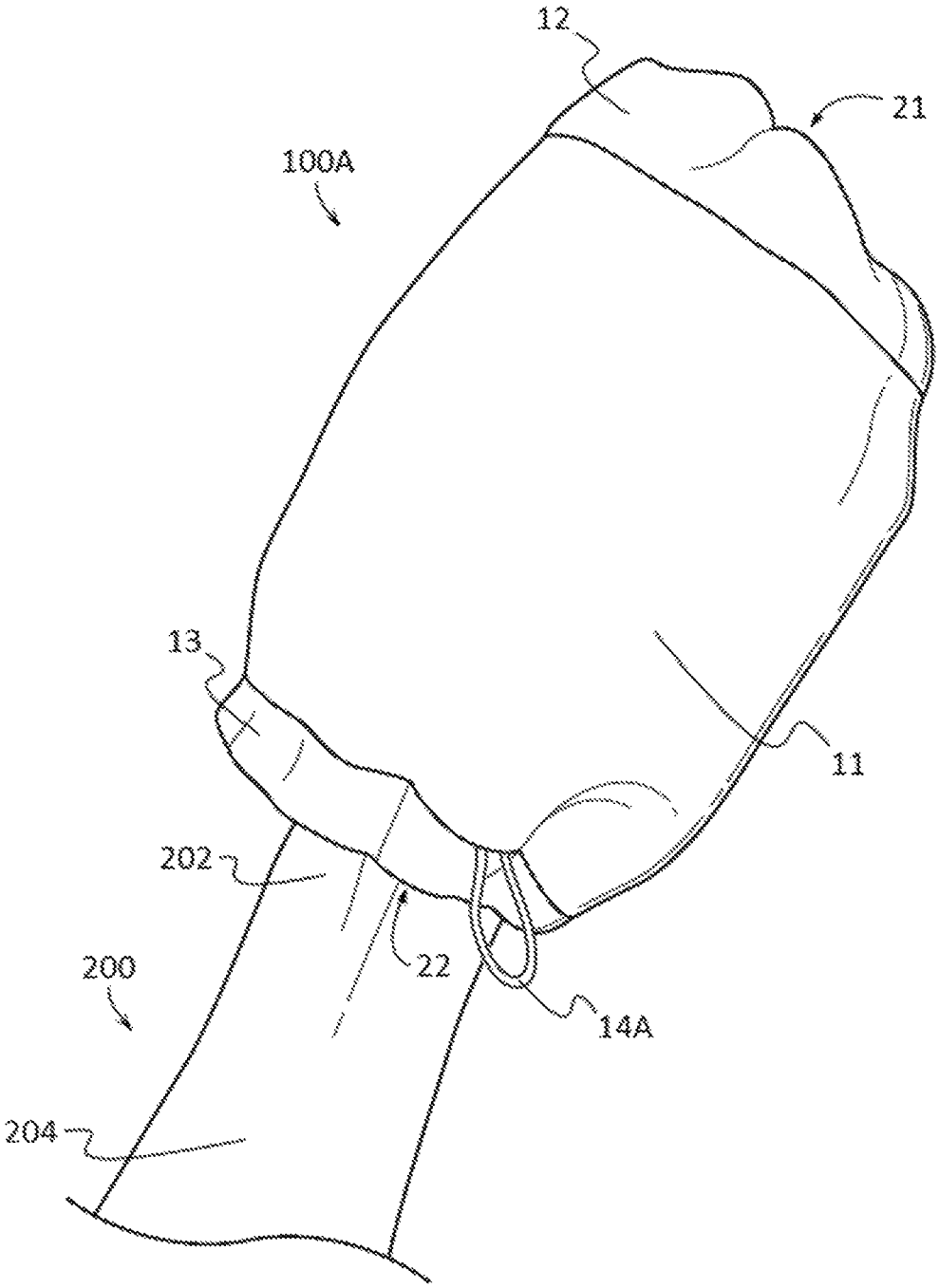
FIG. 7 depicts a perspective view of an example of a female absorbent wristband apparatus worn on the hand of a user according to various embodiments described herein.

FIG. 6 illustrates a perspective view of an example of a male absorbent wristband apparatus 100B worn on the arm 204 of a user 200 according to various embodiments described herein. In this preferred embodiment, the user 200 has inserted their arm 204 through the second end 22, into the cavity 17 (FIGS. 4 and 5) of the body 11, and through the first end 21 of the male apparatus 100B, with the first end 21 positioned closer to the wrist 202 and the second end 22 positioned closer to the elbow 203 of the user 200. The male apparatus 100B may comprise a fastener such as a button fastener 14B which may be preferably coupled to the body 11 proximate to the second end 22 but optionally coupled anywhere on the body 11 of the male apparatus 100B.

In other embodiments, the user 200 may insert their arm through the first end 21, into the cavity 17 of the body 11, and through the second end 22 of the male apparatus 100B, with the second end 22 positioned closer to the wrist 202 and the first end 21 positioned closer to the elbow 203 of the user 200. By positioning the male apparatus 100B on the arm of the user 200, the user's hands are free to wash objects such as the user's face, while any water that runs down the user's arm is caught and absorbed by the male apparatus 100B.

In a similar manner, preferably a user 200 may insert their arm through the second end 22, into the hollow interior of the body 11, and through the first end 21 of a female apparatus 100A (FIGS. 1-3, 7, 8), with the first end 21 positioned closer to the wrist 202 and the second end 22 positioned closer to the elbow 203 of the user 200. In other embodiments, the user 200 may insert their arm through the first end 21, into the cavity 17 of the body 11, and through the second end 22 of a female apparatus 100A, with the second end 22 positioned closer to the wrist 202 and the first end 21 positioned closer to the elbow 203 of the user 200. By positioning the female apparatus 100A on the arm 204 of the user 200, the user's hands are free to wash objects such as the user's face, while any water that runs down the user's arm 204 is caught and absorbed by the female apparatus 100A.

Turning now to FIG. 7, a perspective view of an example of a female absorbent wristband apparatus 100A worn on the hand 201 (FIG. 6) of a user 200 according to various embodiments described herein is shown. In some embodiments, after washing an object, such as their face, with the female apparatus 100A in a position on the arm similar to the position of the male apparatus 100B depicted in FIG. 6, the user may slide the female apparatus 100A over the hand 201 as illustrated in FIG. 7 and they may use dry portions of the female apparatus 100A as a towel to dry their face and/or other objects. In other embodiments, after washing an object, such as their face, with the male apparatus 100B (FIGS. 1, 4-6, 8) in a position on the arm similar to the position of the male apparatus 100B depicted in FIG. 6, the user may slide the male apparatus 100B over the hand 201 to a similar position as the female apparatus 100A is illustrated in FIG. 7 and they may use dry portions of the male apparatus 100B as a towel to dry their face and/or other objects.

A female apparatus 100A may be configured to be used as a washcloth or as a towel. By placing the female apparatus 100A over the hand 201, the user 200 may wash objects, such as a face or body, with wet portions of the female apparatus 100A. After washing the object, the user 200 may rotate the female apparatus 100A around their hand 201 or arm 204 and dry the object with dry portions of the female apparatus 100A. Likewise, a male apparatus 100B (FIGS. 1, 4-6, 8) may be configured to be used as a washcloth or as a towel. By placing the male apparatus 100B over the hand 201, the user 200 may wash objects such as their face with wet portions of the male apparatus 100B. After washing the object, the user 200 may rotate the male apparatus 100B around their hand 201 or arm 204 and dry the object with dry portions of the male apparatus 100B.

In preferred embodiments, an absorbent wristband apparatus 100 comprises a female absorbent wristband apparatus 100A and a male absorbent wristband apparatus 100B (FIG. 1) allowing a female apparatus 100A and/or a male apparatus 100B to wash a desired object, such as a face or body, while the other may be used to dry the object and both may be used to prevent water from running down a user's wrist 202 or arm 204. In other embodiments, an absorbent wristband apparatus 100 may comprise a female apparatus 100A or a male apparatus 100B which may be used to wash a desired object, such as a face or body, to prevent water from running down a user's wrist 202 or arm 204, and to then dry the object.

FIG. 8 depicts a perspective view of an example of an absorbent wristband apparatus 100 comprising a female apparatus 100A and a male apparatus 100B secured to a structure 300, such as a shower curtain rod or towel bar, according to various embodiments described herein. In some embodiments and in the present example, the apparatus 100 may comprise a female apparatus 100A, which includes one or more fasteners such as a loop fastener 14A, and a male apparatus 100B, which includes one or more fasteners such as a button fastener 14B, that are configured to be temporarily attached together. By bending a portion of a body 11 and/or an elastic element 12 of a female apparatus 100A and/or a male apparatus 100B around portions of a structure 300 and then removably coupling the two fasteners 14A, 14B, together, the apparatus 100 may be temporarily secured to the structure 300 to facilitate drying or the storage of the apparatus 100. In other embodiments, a female apparatus 100A and/or a male apparatus 100B may comprise one or more other types of fasteners which may be configured to be removably coupled to another fastener and/or another element of a female apparatus 100A and/or a male apparatus 100B. By optionally bending a portion of a body 11 and/or an elastic element 12 around a structure such as a towel bar, door knob, shower head, drawer knob, hook, and the like and then removably coupling a fastener to another fastener and/or another element of a female apparatus 100A and/or a male apparatus 100B, the apparatus 100 may be temporarily secured to almost any structure 300 to facilitate drying or the storage of the apparatus 100. In further embodiments, a fastener 14A of a female apparatus 100A may be removably coupled to the fastener 14B of the male apparatus 100B, and the apparatus 100 may then be draped over the structure 300 and supported or secured by the removably coupled fasteners 14A, 14B, and/or one or both bodies 11.

While some methods of coupling have been provided, in other embodiments, the elements that comprise the apparatus 100, such as a female apparatus 100A, and/or a male apparatus 100B, each of which may include a body 11, an elastic member 12, and one or more fasteners 14, may be coupled by being connected, removably connected, or integrally formed or molded with the apparatus 100, such as a female apparatus 100A, and/or a male apparatus 100B. In some embodiments, body 11, an elastic member 12, and/or one or more fasteners 14, such as a loop fastener 14A and a button fastener 14B, may be coupled or connected together with heat bonding, chemical bonding, adhesives, clasp type fasteners, clip type fasteners, rivet type fasteners, threaded type fasteners, other types of fasteners, or any other suitable joining method. In other embodiments, a body 11, an elastic member 12, and/or one or more fasteners 14, such as a loop fastener 14A and a button fastener 14B, may be coupled or removably connected by being press fit or snap fit together, by one or more fasteners such as magnetic type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, a body 11, an elastic member 12, one or more fasteners 14, such as a loop fastener 14A and a button fastener 14B, and/or any other element described herein may be coupled by being one of connected to and integrally formed with another element of the apparatus 100, such as a female apparatus 100A, and/or a male apparatus 100B.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An absorbent wristband drying system, the absorbent wristband drying system comprising the combination of a:

a female absorbent wristband apparatus, wherein the first female absorbent wristband apparatus comprises:

i. a first female body made from an absorbent material with a first end and a second end, wherein the first female body is formed into a hollow cylindrical shape with a first opening at the first end and a second opening at the second end;

ii. a first cavity disposed in the first female body and being continuous between the first opening at the first end and the second opening at the second end;

iii. an elastic element coupled at the first end of the first female body and an elastic element coupled at the second end of the first female body; and iv. a loop fastener coupled to the first female body;

a male absorbent wristband apparatus separate and discrete from the female wristband apparatus, wherein the male absorbent wristband apparatus comprises:

i. a second male body made from an absorbent material with a first end and a second end, wherein the second male body is formed into a hollow cylindrical shape with a first opening at the first end and a second opening at the second end;

ii. a second cavity disposed in the second male body and being continuous between the first opening at the first end and the second opening at the second end;

iii. an elastic element coupled at the first end of the second male body and an elastic element coupled at the second end of the second male body;

iv. a male fastener coupled to the second male body; and the male fastener of the male absorbent wristband apparatus positioned in-between the loop fastener of the female absorbent wristband apparatus thereby forming a combination of the male absorbent wristband apparatus to the female absorbent wristband apparatus and the combination designed to hang over a structure such as a shower curtain rod or towel bar when not in use.

2. The system of claim 1, wherein the absorbent material comprises a material selected from the group consisting essentially of: fabric materials, polyester, polyamides, acrylic, nylon, rayon, acetate, spandex, lastex, coir, cotton, terry cloth, hemp, jute, linen, ramie, wool, silk, and combinations thereof.

3. The system of claim 1, wherein the elastic element comprises a material selected from the group consisting essentially of braided elastic materials, woven elastic materials, knitted elastic materials, braided elastic fabric materials, woven elastic fabric materials, knitted elastic fabric materials, neoprene, spandex, elastane, cotton swimwear elastic, roll elastic, non-roll elastic, rubber, silicone, elastic plastics, elastic silicone, elastic rubbers, silicone rubbers, and combinations thereof.

4. The system of claim 1, wherein the size of the opening at the first end of the female absorbent wristband apparatus is governed by the elastic element coupled at the first end of the female absorbent wristband apparatus, and wherein the size of the opening at the first end of the male absorbent wristband apparatus is governed by the elastic element coupled at the first end of the male absorbent wristband apparatus.

5. The system of claim 1, wherein the size of the body of the opening at the second end of the female absorbent wristband apparatus is governed by the elastic element coupled at the second end of the female absorbent wristband apparatus, and wherein the size of the opening at the second end of the male absorbent wristband apparatus is governed by the elastic element coupled at the second end of the male absorbent wristband apparatus.

6. The system of claim 1, wherein the fastener of the female absorbent wristband apparatus is coupled to the body proximate to the second end of the female absorbent wristband apparatus, and wherein the fastener of the male absorbent wristband apparatus is coupled to the body proximate to the second end of the male absorbent wristband apparatus.

7. The system of claim 1, wherein the male fastener of the male absorbent wristband apparatus is selected from the group consisting of a button fastener, a loop fastener, a magnetic type fastener, hook and loop type fastener, sealable tongue and groove fastener, a snap fastener, a clip type fastener, and a clasp type fastener, and wherein the fastener of the male absorbent wristband apparatus is selected from the group consisting of a button fastener, a loop fastener, a magnetic type fastener, hook and loop type fastener, sealable tongue and groove fastener, a snap fastener, a clip type fastener, and a clasp type fastener.

8. The system of claim 7, wherein the fastener of the female absorbent wristband apparatus comprises a loop fastener sewn to the body proximate to the second end of the female absorbent wristband apparatus, and wherein the fastener of the male absorbent wristband apparatus comprises a button fastener sewn to the body proximate to the second end of the male absorbent wristband apparatus.

9. The system of claim 1, wherein the first end of the female absorbent wristband apparatus comprises two or more layers of an absorbent material surrounding the elastic element of the first end of the female absorbent wristband apparatus, and wherein the first end of the male absorbent wristband apparatus comprises two or more layers of an absorbent material surrounding the elastic element of the first end of the male absorbent wristband apparatus.

10. The system of claim 1, wherein the cavity of the female absorbent wristband apparatus permits approximately 20 percent to 100 percent of the hand of a user to be received within the cavity of the female absorbent wristband apparatus, and wherein the cavity of the male absorbent wristband apparatus permits approximately 20 percent to 100 percent of the hand of a user to be received within the cavity of the male absorbent wristband apparatus.

11. The system of claim 1 wherein the male fastener is a button type fastener.

12. The system of claim 11, wherein the male fastener is a round button type fastener.

13. The system of claim 12, further comprising a rod and wherein the male absorbent wristband apparatus and the female absorbent wristband apparatus are coupled to each other and hung over the rod.

* * * * *